United States Patent [19]

Harth et al.

[11] Patent Number: 5,009,424

[45] Date of Patent: Apr. 23, 1991

[54] GAMEBOARD AMUSEMENT DEVICE

[76] Inventors: Arthur Harth, 4150 W. Barry, Chicago, Ill. 60641; Adrian T. Dowbrowski, R.R. 1, Box 251A, Remington, Ind. 47977; Bernard O. Williams, 239 E. Northend Ave., Elmhurst, Ill. 60126

[21] Appl. No.: 409,804

[22] Filed: Sep. 20, 1989

[51] Int. Cl.[5] ..... A63F 9/14; A63F 13/06

[52] U.S. Cl. ..... 273/85 D; 273/85 F; 446/334

[58] Field of Search ..... 273/85 F, 85 A, 85 B, 273/85 C, 85 D; 446/333, 334, 330

[56] References Cited

U.S. PATENT DOCUMENTS

| | | | |
|---|---|---|---|
| 1,736,163 | 11/1929 | McGee | 446/334 |
| 1,799,735 | 4/1931 | Crowell | 446/334 |
| 1,812,930 | 7/1931 | Chester | 446/335 |
| 2,088,510 | 7/1937 | Frasca | 446/334 |
| 2,716,840 | 9/1955 | Armstrong | 446/334 |
| 3,845,956 | 11/1974 | Goldfarb | 273/85 F |
| 4,367,875 | 1/1983 | Barlow et al. | 273/85 F |

*Primary Examiner*—Edward M. Coven
*Assistant Examiner*—Sebastiano Passaniti
*Attorney, Agent, or Firm*—Patula & Associates

[57] ABSTRACT

A gameboard amusement device for simulating an athletic game, contest or event having a gameboard upon which at least two gameboard contact figures engage in contact as directed by a game player, one for each contact figure, through mechanical means comprising a handle, grasped by the player, which handle houses triggers connected mechanically, through a cylinder and contact figure pedestal, to limbs of each contact figure to effect limb movement upon depression and release of the triggers. Each contact figure carries release means at a position on the contact figure which is vulnerable of contact by an opposing contact figure and, upon such contact, causes the contacted figure to fall backward from an upright position in simulation of defeat. The release means can be adjustable to vary the force and player strength required to effect defeat.

20 Claims, 4 Drawing Sheets

GAMEBOARD AMUSEMENT DEVICE

The present invention relates generally to a gameboard amusement device for at least two opposing players using a common gameboard with figures thereon which are manipulated by the players, particularly through hand operative mechanical means used to engage the figures in simulation of athletic contact.

BACKGROUND OF THE INVENTION

Arcade games in the past have employed the concept and practice of gameboard figures which are movable and, particularly, which move in response to some hand-held or hand operative mechanical means manipulated by one or more players. Hand-held mechanically operated gameboard devices can consist of a variety of mechanical and/or electric-mechanical manipulation means. The number of gameboard figures and manipulation means may vary, as might the number of game players. Generally, these devices simulate athletic games, contests or events.

Arcade-type athletic games utilizing hand-operated means to mechanically manipulate a gameboard figure frequently lack authentic simulation of the actual athletic event, game or contest being simulated. The conventional arcade game utilizes mechanical means to move figures on a gameboard, either to contact other figures, to manipulate a game ball, or to effect some other contest. Frequently, the hand-held mechanical means of the arcade game is unrelated in degree of physical skill and prowess required to play the actual athletic game. For example, the heretobefore known conventional arcade-type boxing game would not simulate the strength, agility or prowess required in the actual sport of boxing to deliver punches and succeed at the game using the mechanical means of the conventional gameboard.

Further, gameboard contact figure amusement devices previously have combined mechanical and electrical means, or utilized either of these means independently, to engage the gameboard figures in a boxing match, the object being to defeat one's opponent by a knock-out contact punch or the like. Previous amusement devices of this type, however, do not simulate realistic combat because, taking the example play cited above, the knock-out punch is effected by a trigger or electric switch which causes a defeated figure to fall upon contact with that switch regardless of the force or placement of the defeating hit. Thereby not actually simulating the strength or stamina of the boxers in an actual boxing match.

The present invention relates to a mechanically operated amusement device with at least two gameboard figures engaged in direct combat by operation of mechanical manipulation means directed from respective players. One object of the present invention is to provide a mechanically operated game which translates the skill, strength and agility of each player through mechanical means to the respectively operated gameboard figures and simulates the actual athletic skill and ability involved in playing the sport or contest being simulated.

Another object of the present invention is to eliminate automatic defeat by mere contact with a switch but, rather, to require a combination of strength and agility through use of mechanical manipulation means to place contact on an opposing contact figure in order to defeat that figure in combat.

Another object of the invention is to provide for a mechanical adjustment separate from the means for manipulating contact figures on a gameboard whereby the amusement device can be adjusted to accommodate and challenge players of varying skill and strength.

Numerous other advantages and features of the invention will become readily apparent from the detailed description of the preferred embodiment of the invention, from the claims, and from the accompanying drawings, in which like numerals are employed to designate like parts throughout the same.

BRIEF SUMMARY OF THE INVENTION

An amusement device which provides for contact figures to be moved and manipulated mechanically across a gameboard to achieve contact with an opposing contact figure, each figure manipulated by a respective player of the device. The contact figure is attached to a hollow cylinder pivotably and slidably affixed under the gameboard. Actuator rods run from movable arms on each contact figure, through the hollow cylinder, and to triggers located in a handle positioned on the opposite end of the hollow cylinder, which handle protrudes from the perimeter of the gameboard to allow for grasping by each respective player working a given contact figure. Each contact figure has a push rod positioned in a vulnerable contact position on that figure and a mechanical release mechanism to effect defeat when the push rod is forcibly depressed by an opposing contact figure, causing the contacted figure to fall backward in simulation of defeat. The release mechanism can be adjustable to require varying degrees of force to effect full release and consequent backward fall of the contacted figure.

BRIEF DESCRIPTION OF THE DRAWINGS

A fuller understanding of the foregoing may be derived by reference to the accompanying drawings, wherein.

DETAILED DESCRIPTION OF THE PREFERRED EMBODIMENT OF THE INVENTION

Figure 1:
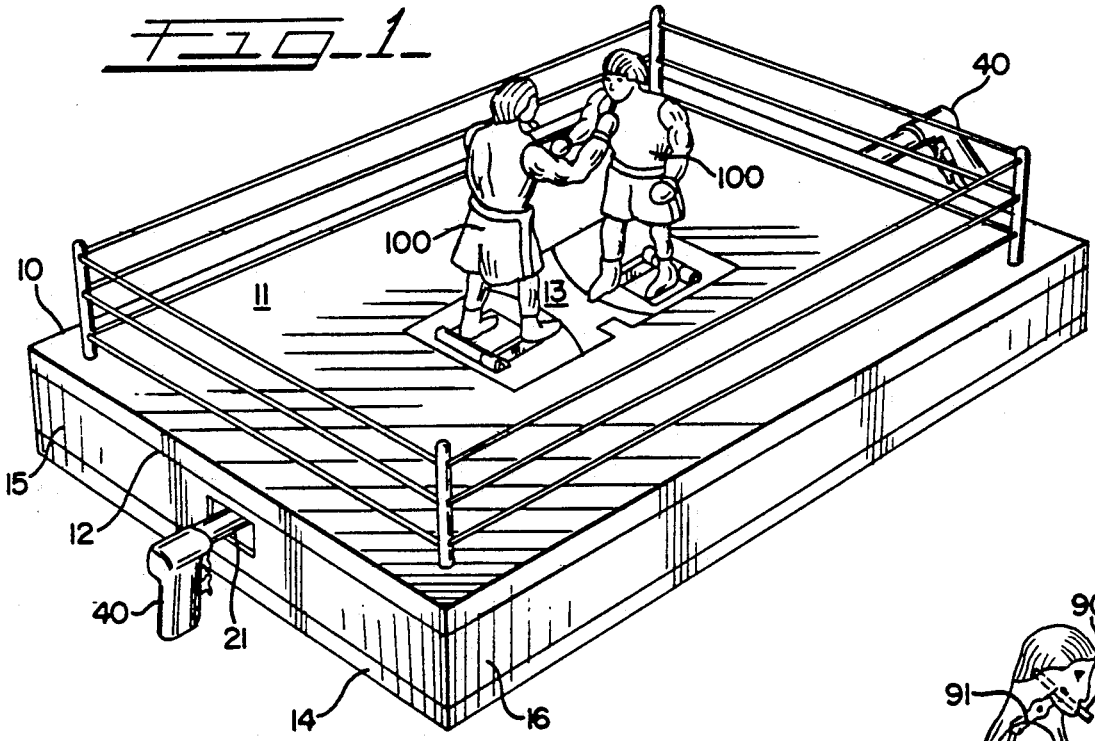
FIG. 1 is a perspective view of the gameboard surface of the amusement device showing two opposing contact figures.

While the invention is susceptible of embodiment in many different forms there is shown in the drawings and will be described herein in detail, a preferred embodiment of the invention. It should be understood, however, that the present disclosure is to be considered an exemplification of the principles of the invention and is not intended to limit the spirit and scope of the invention and/or claims of the embodiment illustrated.

Referring now to FIG. 1, the numeral 10 refers generally to the gameboard of the amusement device. The gameboard is generally rectangular, and has a top playing surface 11, an accessible underside 12, and a center play area defined by an opening 13 in the gameboard 10. In the preferred embodiment of the invention, the amusement device is further defined by a gameboard base support 14 of the same size and shape as gameboard 10 upon which conventional support means 15 and 16 stand at the periphery of and perpendicular to the base support 14, which support the gameboard 10. FIG. 1 shows two opposing contact FIGS. 100. The contact FIGS. 100 face each other and stand upright above top playing surface 11 through opening 13 which defines the area of movement and game play of the contact figures 100.

Figure 2:
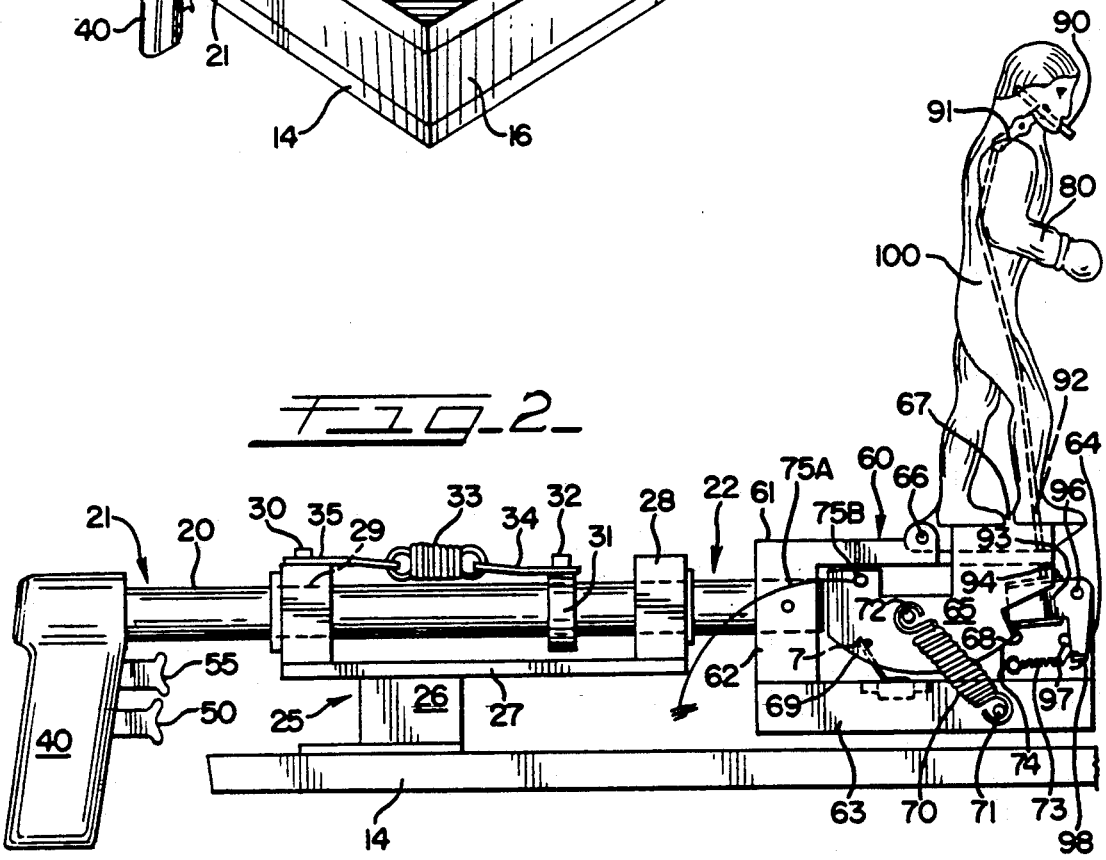
FIG. 2 is a side elevational view of one hollow cylinder with the handle portrayed at the trigger end and contact figure portrayed at the pedestal end of the cylinder, and further depicting the mount mechanism which affixes the cylinder under the gameboard.

FIG. 2 portrays the mechanism for moving a contact figure 100. A side elevational view of one hollow cylinder 20 with the handle 40 portrayed at the trigger end 21 of the mechanism, which trigger end 21 protrudes beyond the periphery of the gameboard 10, and the contact FIG. 100 portrayed at the pedestal end 22 of the mechanism.

Handle 40 houses trigger 50 and trigger 55 which are depressed and released to manipulate the movable arms 80 and 85 (not shown in FIG. 2), respectively. The hollow cylinder 20 is threaded through rings 28 and 29 of pivot and slide mount 25, which rings 28 and 29 slidably hold the hollow cylinder 20 in position generally parallel to the gameboard 10. Rings 28 and 29 are supported by plate 27 of pivot and slide mount 25. Plate 27 is pivotably attached to pivot base support 26, which is mounted to gameboard base support 14. The pivot and slide mount 25 enables slide motion of the hollow cylinder 29 by pushing the handle 40 forward or pulling it backward to move or slide the hollow cylinder and, consequently, the contact FIG. 100 forward or backward, respectively, and pivot motion by swinging the handle 40 from side to side in a plane parallel to the gameboard 10 to move the hollow cylinder 20 and contact FIG. 100 from side to side within opening 13 as shown in FIG. 1 of the gameboard 10.

Ring 31 shown in cross-section is fixedly secured to the outer perimeter of hollow cylinder 20 at a position between rings 28 and 29 (also shown in cross-section) of the pivot and slide mount 25. Spring 33 has a forward attachment 34 connected to pin 32 of ring 31 and a rear attachment 35 connected to pin 30 of ring 29 to provide tensioning means for controlling slide motion of the hollow cylinder 20 within the pivot and slide mount 25.

Pedestal end 22 of hollow cylinder 20 is comprised of fixed pedestal 60 having a casement formed of top wall 61 connected generally perpendicularly to side wall 62, which is connected in turn, generally perpendicularly, to bottom wall 63, which is connected in turn, generally perpendicularly, to side wall 64. Hollow cylinder 20 is further comprised of pivot pedestal 65 which is housed removably within fixed pedestal 60 when contact FIG. 100 is standing in an upright position. Pedestal end 22 sits generally under gameboard opening 13, except for the contact FIG. 100 which sits above the gameboard top surface 11.

Fixed pedestal 60 is secured to the hollow cylinder 20 at side wall 62. Pivot pedestal 65 is pivotably secured to fixed pedestal 60 at pivot joint 66. Pivot pedestal 65 is comprised of a foot support edge 67 upon which contact FIG. 100 is mounted. Pivot joint 66 pivotably connects foot support edge 67 of pivot pedestal 65 and top wall 61 of fixed pedestal 60. Pivot pedestal 65 is further defined by pawl contact ridge 68, and arcuate edge 69.

Tension spring 70 is connected to pivot pedestal 65 at pin 72 and to bottom wall 63 at pin 71 to create a tensioned state of spring 70 when contact FIG. 100 is in an upright position and pivot pedestal 65 is recessed within fixed pedestal 60. Upright reset cable 75A is attached to upright reset stud 75B on pivot pedestal 65. Upright reset cable 75A connects to mechanical means which may be a motor or other conventional device (not shown) which draw upright reset cable 75A and stud 75B to reset contact FIG. 100 to an upright position after a contact and backward fall, and which provides slack to upright reset cable 75A when contact figure falls backward and pivot pedestal 65 is drawn outside of fixed pedestal 60. Withdrawal of upright reset cable 75A within the mechanical means pulls pivot pedestal 65 which causes pivot pedestal 65 to return to recessed position within fixed pedestal 60 after contact FIG. 100 has been hit and fallen backwards, thereby swinging contact FIG. 100 forward and upright. Reset sensor 7 electrically senses via arcuate edge 69 that contact FIG. 100 has fallen backward and is interfaced with a conventional electrical interface for scoring and/or other functions.

Pivot pedestal 65 is held in the tensioned position recessed within fixed pedestal 60 when pawl 93 abuts pawl contact ridge 68 of pivot pedestal 65. Pivot pedestal 65 is released from its tensioned position when mouth push rod 90 is depressed by contact from an opposing contact FIG. 100. Mouth push rod 90 is connected to pivot lever 91 and, when depressed, pushes the pivot lever 91 backward which causes the actuator release rod 92 connected to the end of pivot lever 91 opposite mouth push rod 90 to be pushed downward by pivot lever 91. Actuator release rod 92 is connected at the foot end of contact FIG. 100 to pawl-rod surface 94. Upon downward push of actuator release rod 92 by pivot lever 91, actuator release rod 92 in turn pushes pawl 93 downward to downwardly pivot pawl 93 on pivot 96, which pivot 96 pivotably connects pawl 93 to side wall 64, thus pivoting pawl 93 away from contact with pivot pedestal 65 at pivot contact ridge 68, thereby allowing tension spring 70 to contract and, in the process, to swing pivot pedestal 65 outside of fixed pedestal 60 by pivoting the contact FIG. 100 on pivot 66 and cause the contact FIG. 100 to fall backward.

Figure 3:
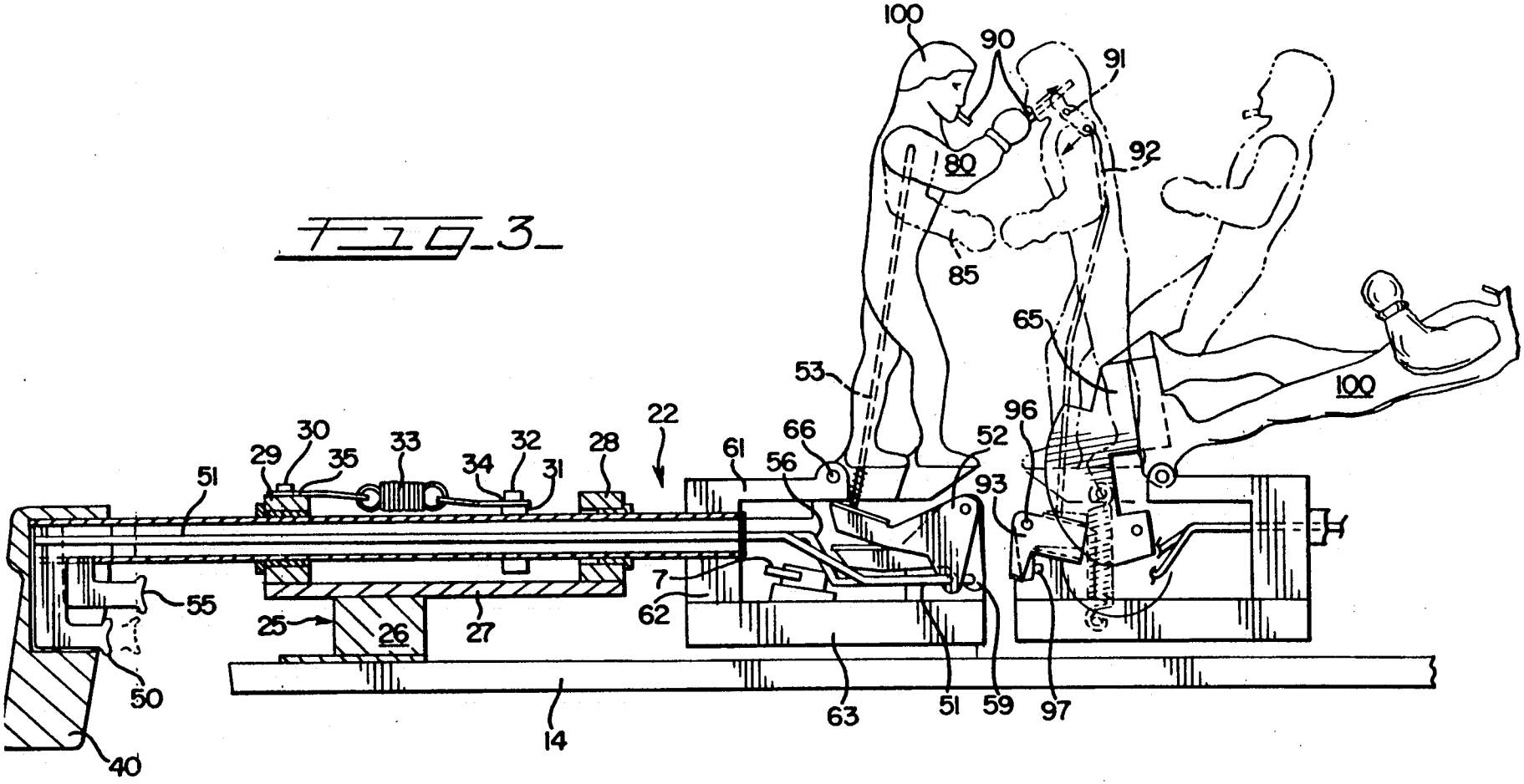
FIG. 3 is a side elevational cross-sectional view of one hollow cylinder depicting the contact figure in various stages of upright to fallen back position by effect of contact figure release.

FIG. 3 is a cross-sectional side view of hollow cylinder 20 showing an upright contact FIG. 100 having delivered a right-handed punch to a fallen contact FIG. 100. In operation, when an operator or game player desires to throw a "punch," trigger 50 is depressed in handle 40 as shown, thereby causing actuator rod 51 to pull forward which in turn causes pivot plate 52 to which actuator rod 51 is connected to pivot in the direction of and toward handle 40, thereby pushing right arm actuator rod 53 upward. Right arm actuator rod 53 is connected to right arm push rod 54 housed within the shoulder of right arm 80, which right arm push rod 54 is in turn pushed upward by upward motion contact with right arm actuator rod 53, causing right arm 80 to move upward for punching action, in response to force from right arm push rod 54, which is pushed upward by right arm actuator rod 53, which is pushed upward by pivot plate 52 in response to pulling by actuator rod 51 in response to the operator depressing trigger 50.

Depression of trigger 55 by an operator similarly effects movement of left arm 85 by pulling actuator rod 56 toward handle 40, pivoting pivot plate 57 forward toward handle 40 which in turn pushes left arm actuator rod 58, connected to left arm push rod 59, housed within the shoulder of left arm 85, upward to effect punching action. Depression of triggers 50 and 55 effects punching action of right arm 80 and left arm 85 respectively. Release of triggers 50 and 55 effects release of right arm 80 and left arm 85 respectively. These separate trigger mechanisms for actuating movement of the right arm 80 and left arm 85 can be operated simultaneously to effect a variety of maneuvers, including concomitant punching and blocking action.

In further description of the operation of the preferred embodiment of the invention, FIG. 3 depicts the operation of a punch, causing a "knock-down" by the depression of mouth push rod 90 upon contact with right arm 80 of an opposing contact figure 100, which contact has caused mouth push rod 90 to pivot the pivot lever 91 such that release actuator rod 92. Consequently the opposing contact FIG. 100 is pushed downward. Downward push of release actuator rod 92 likewise pushes pawl 93 downward, thereby pivoting pawl 93 on pivot 96 until pawl 93 contacts pin 97, after which point pawl 93 no longer abuts pivot pedestal 65 at pivot pedestal edge 68. Absent contact between pawl 93 and pivot pedestal edge 68, tension spring 70 contracts to swing pivot pedestal 65 out from inside of fixed pedestal 60, causing contact FIG. 100 to fall backward.

Looking generally at the figures, and specifically FIG. 3, tension spring 70 is depicted in its alternate position, generally perpendicular to bottom wall 63, after release of contact FIG. 100 and consequent backward fall.

FIG. 2 also shows an additional tension spring 73 affixed at one end to support 74, which support 74 is secured to bottom wall 63, spring 73 being connected at its other end to pawl 93 at pawl end 98 to add tensioning mean for holding pawl 93 abutted against pedestal contact edge 68.

Figure 4:
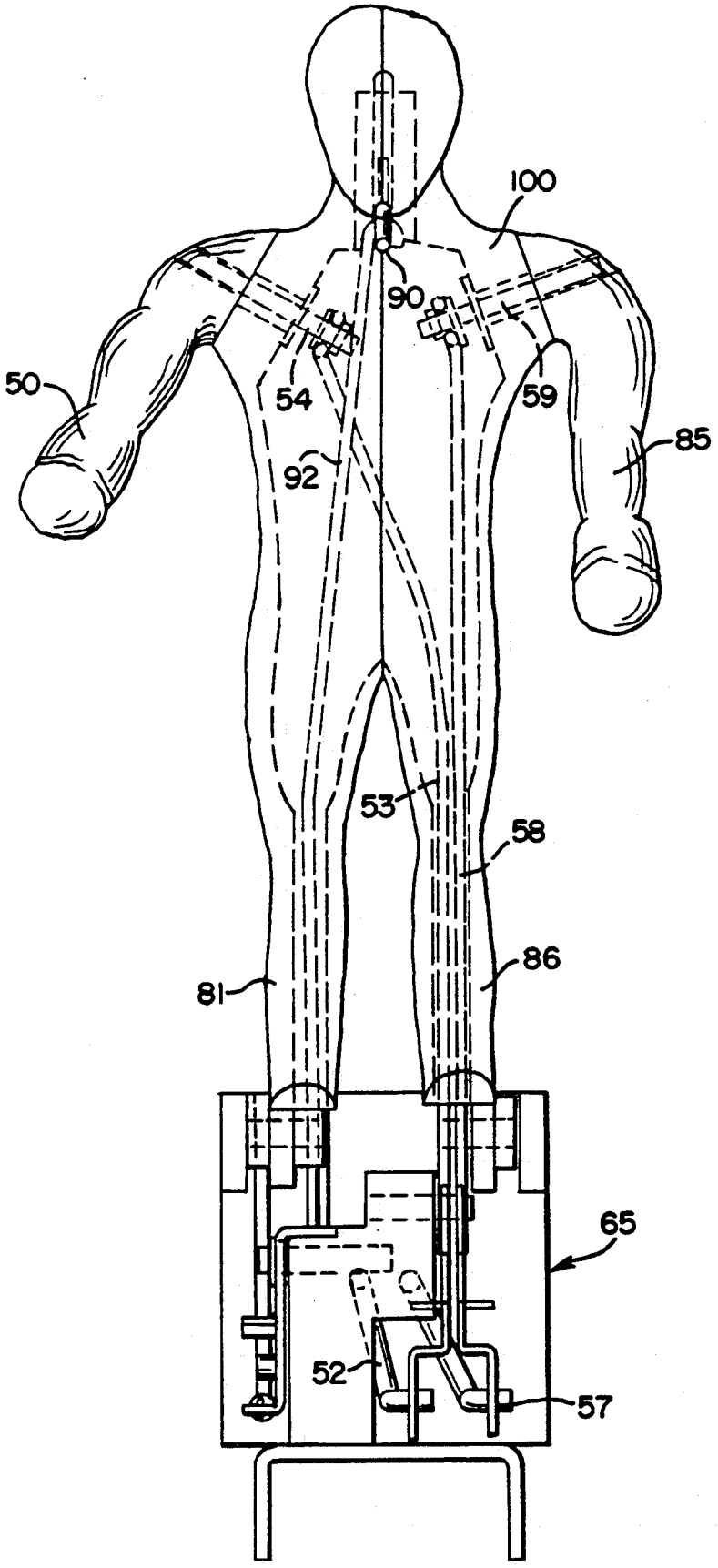
FIG. 4 is a front elevational cross-sectional view of a contact figure, showing pivot plates, movable arm actuator rods through the left leg of the contact figure and the release means actuator rod through the right leg of the contact figure.

FIG. 4 is a front cross-sectional view of contact figure 100, showing left arm actuator rod 58 and right arm actuator rod 53 running through left leg ,86 of contact FIG. 100. Left arm actuator rod 58 is shown connected to left arm push rod 59 in the left shoulder of le ft arm 85. Right arm actuator rod 53 is shown connected to right arm push rod 54 in the right shoulder of right arm 80. Mouth push rod 90 is shown at the mouth position of contact FIG. 100. Release actuator rod 92 is shown running through the right leg 81 of contact FIG. 100. Pivot plates 52 and 57 also are shown connecting to right arm actuator rod and left arm actuator rod 58, respectively, within pivot pedestal 65.

Figure 5:
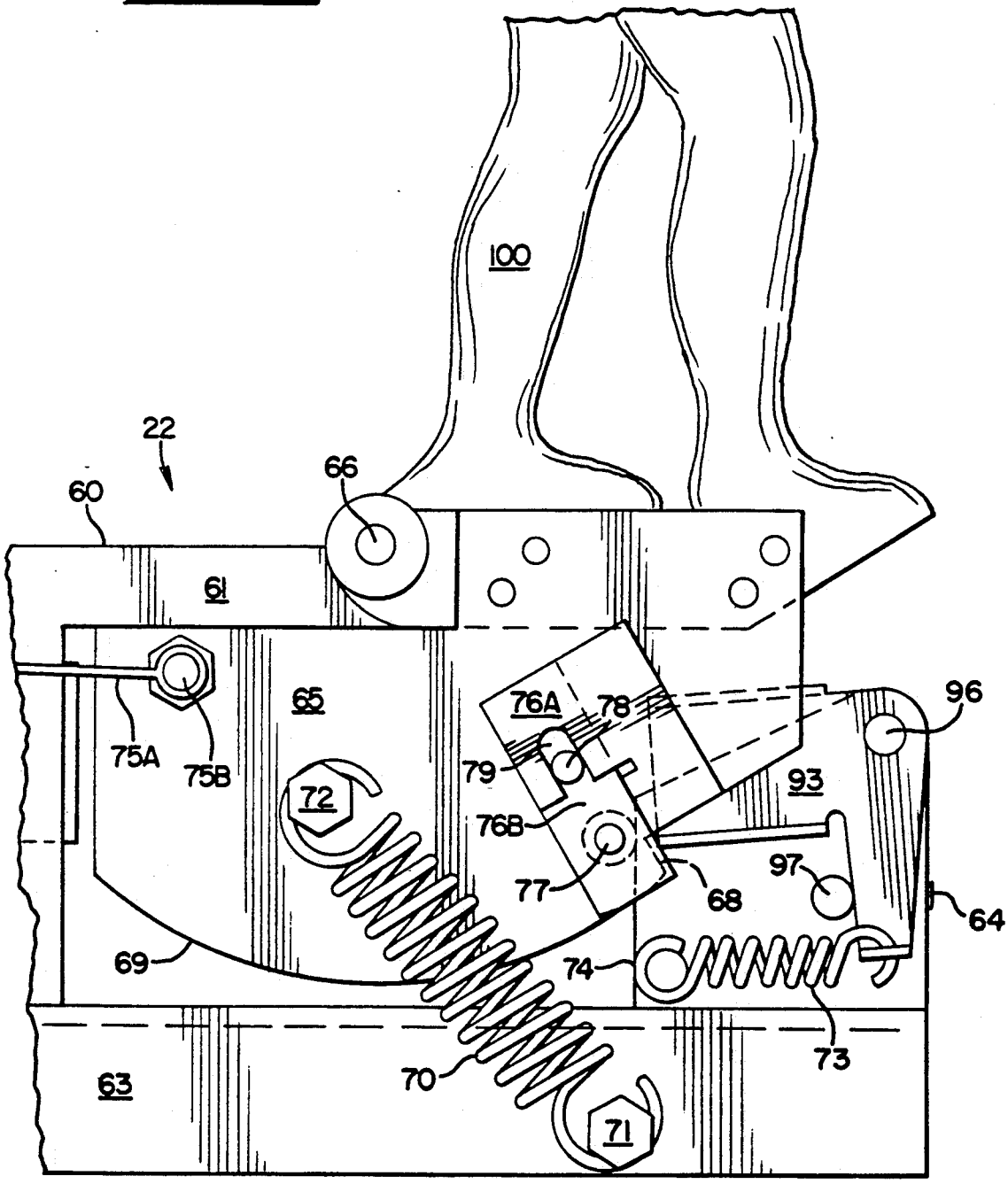
FIG. 5 is a side elevational view of the pivot pedestal located at the pedestal end of the hollow cylinder, depicting the adjustment means which varies the level of force and skill required to effectuate release of a contact figure.

FIG. 5 is a side elevational view of pedestal end 22 with adjustment plates 76A and 76B slidably mounted on pivot pedestal 65. The amount of engagement between adjustment plates 76A and 76B and pawl 93 is varied by loosening nut 77 and 78 to slide adjustment plates 76A and 76B, respectively, into recessed versus protruded position relative to pedestal contact edge 68, then locking nut 77 and 78 to secure adjustment plate 76A and 76B against pivot pedestal 65. The amount of engagement between adjustment plates 76A and 76B and pawl 93 increases with decreasing degree of recession into recess 79, thereby requiring greater force of contact to effect release of contact FIG. 100. Sliding the adjustment plates 76A and 76B into protruded position decreases the amount engagement between adjustment plates 76A and 76B and pawl 93 at pivot pedestal edge 68, thereby requiring less force to overcome contact between pawl 93 and pivot pedestal 65 and pivot pedestal edge 68 in order to effect release of contact FIG. 100 backward.

The foregoing specification describes only the preferred embodiment of the invention as shown. Other embodiments besides boxing matches may be articulated as well. The terms and expressions therefore serve only to describe the invention by example only and not to limit the invention. It is expected that others will perceive differences which while differing from the foregoing, do not depart from the spirit and scope of the invention herein described and claimed.

What is claimed is:

1. A mechanically operated gameboard amusement device, comprising; in combination:

gameboard having a top playing surface with an accessible underside with a center play area defined by at least one opening in said surface;

a plurality of independent hollow cylinders, each having a pedestal end and a trigger end and extending continuously therebetween with each of said cylinders movably mounted under said gameboard;

pivot means for movably pivoting and slide mounting each of said cylinders under said gameboard;

operator means for grasping said trigger end of each of said cylinders;

actuator means for delivering mechanical force from said operator means to said pedestal end;

at least two contact figures pivotably mounted upright upon each of said pedestal ends through said opening, each of said contact figures having a contact figure pivot pedestal removably recessed within a fixed pedestal when said contact figure is positioned upright, and each having a plurality of movable arms cooperatively associated with said actuator means to deliver contact force to an opposing contact figure, said contact figures further defined by having release means for releasing said contact figures from said upright position to a position other than said upright position upon contact from an opposing contact figure, whereby each operator participating in play of said amusement device grasps said operator means and manipulates same in combination with said pivot means and said actuator means to attempt contact between said movable arms and said release means of an opposing contact figure.

2. The amusement device recited in claim 1, wherein said pivot means comprises a pivot and slide mount secured to said underside of said gameboard and adapted to receive said hollow cylinder to allow forward and backward slide motion of said hollow cylinder relative to the center of said gameboard, as well as pivot motion to allow said pedestal end of said hollow cylinder to swing from side to side of said gameboard.

3. The amusement device recited in claim 1, further defined by having support means depended from said underside of said gameboard and supported on a base support of generally the same size and shape as said gameboard, wherein said pivot means comprises a pivot and slide mount secured to said base support and adapted to receive said hollow cylinder to allow forward and backward slide motion of said hollow cylinder relative to the center of said gameboard, as well as pivot motion to allow said pedestal end of said hollow cylinder to swing from side to side of said gameboard.

4. The amusement device recited in claim 1, wherein said operator means comprises a handle at said trigger end of said hollow cylinder, said handle housing a plurality of triggers corresponding to each of said movable arms, said handle being grasped by a player of said amusement device to direct pivot and slide motion of said pivot means, and to trigger said actuator means.

5. The amusement device recited in claim 4, wherein said actuator means is housed , within said handle, said hollow cylinder, said pivot pedestal and said contact figure and is comprised of one set of actuation means for each of said movable arms, each set of actuation means having a trigger cooperatively associated with an actuator rod pivotably connected to a pivot plate which is connected to an arm actuator rod, which said arm actuator rod is connected in turn to a shoulder push rod, whereby depression of said trigger end causes pull of said actuator rod which in turn rocks said pivot plate forward causing said arm actuator rod to push upward and in turn push said shoulder push rod upward to thrust said movable arm likewise upward to project contact attempts by upward thrusts of said movable arm, with downward release of said movable arm effected reversely by release of said trigger.

6. The amusement device of claim 1, wherein said release means comprises a push rod depressably housed within each said contact figure at a position vulnerable of contact by an opposing contact figure, said push rod being cooperatively associated with a pivot lever within said contact figure, said pivot lever cooperatively associated with a release actuator rod within said contact figure and connected to a tension pawl pivotably associated with said fixed pedestal and below said contact figure, said tension pawl holding said contact figure in said upright position upon said pivot pedestal, said release means further defined by tensioning means to provide tensioned recess of said pivot pedestal within said fixed pedestal while said contact figure is held upright, and to release said tension to provide release force for said contact figure to fall backward upon release of said tension pawl, whereby contact by one of said movable arms of an opposing contact figure with said push rod depresses said push rod which pivots said pivot lever, which in turn lowers said release actuator rod and thereby lowers said tension pawl to push said tension pawl away from contact with said contact figure to actuate said tensioning means and cause consequent backward fall of said contact figure.

7. A mechanically operated gameboard amusement device, comprising; in combination:

gameboard having a top playing surface with an accessible underside with a center play area defined by at least one opening in said surface;

a plurality of hollow cylinders, each having a pedestal end and a trigger end, with each of aid cylinders movably mounted under said gameboard;

pivot means for movably pivoting and slide mounting each of said cylinders under said gameboard;

operator means for grasping said trigger end of each of said cylinders;

actuator means for delivering mechanical force from said operator means to said pedestal end;

at least two contact figures pivotably mounted upright upon each of aid pedestal ends through said opening, each of said contact figures having a contact figure pivot pedestal removably recessed within a fixed pedestal when said contact figure is positioned upright, and each having a plurality of movably arms cooperatively associated with said actuator means to deliver contact force to an opposing contact figure, said contact figures further defined by having release means for releasing said contact figures from said upright position to a position other than said upright position upon contact from an opposing contact figure, whereby each operator participating in play of said amusement device grasps said operator means and manipulates same in combination with said pivot means and said actuator means to attempt contact between said movable arms and said release means of an opposing contact figure, wherein said release means comprises a push rod depressably housed within each said contact figure at a position vulnerable of contact by an opposing contact figure, said push rod being cooperatively associated with a pivot lever within said contact figure, said pivot lever cooperatively associated with a release actuator rod within said contact figure and connected to a tension pawl pivotably associated with said fixed pedestal and below said contact figure, said tension pawl holding said contact figure in said upright position upon said pivot pedestal, said release means further defined by tensioning means to provide tensioned recess of said pivot pedestal within said fixed pedestal while said contact figure is held upright, and to release said tension to provide release force for said contact figure to fall backward upon release of aid tension pawl, whereby contact by one of said movable arms of an opposing contact figure with said push rod depresses said push rod which pivots said pivot lever, which in turn lowers said release actuator rod and thereby lowers said tension pawl to push said tension pawl away from contact with said contact figure to actuate said tensioning means and cause consequent backward falling of said contact figure, wherein said tensioning means consists of a first spring and a second spring, said first spring connected directly between said pivot pedestal and said fixed pedestal and set in tensioned position when said contact figure stands upright and allowed to untense said first spring when said tensioning pawl is release from contact with said pivot pedestal, said second spring tensed between said tension pawl and said fixed pedestal and providing additional tensioning force for actuating said release means to effect backward fall of said contact figure.

8. The amusement device of claim 1, further comprising skill adjustment means for varying the degree of force necessary to activate and release means by contact from one of said movable arms of an opposing contact figure, in which the skill adjustment means comprises at least one adjustable plate secured to said pivot pedestal and in a position to adjustably cooperate with said release means to increase the level of force required to effect said release means by increasing contact between said adjustable plate and said release means, and to decrease the level of force required to effect said release means by decreasing contact between said adjustable plate and said release means.

9. A mechanically operated gameboard amusement device, comprising; in combination:

gameboard having a top playing surface with an accessible underside with a center play area defined by at least one opening in said surface;

a plurality of hollow cylinders, each having a pedestal end and a trigger end, with each of said cylinders movably mounted under said gameboard;

pivot means for movably pivoting and slide mounting each of said cylinders under said gameboard;

operator means for grasping said trigger end of each of said cylinders;

actuator means for delivering mechanical force from said operator means to said pedestal end;

at least two contact figures pivotably mounted upright upon each of aid pedestal end s through said opening, each of said contact figures having a contact figure pivot pedestal removably recessed within a fixed pedestal when said contact figure is positioned upright, and each having a plurality of movably arms cooperatively associated with said actuator means to deliver contact force to an opposing contact figure, said contact figures further defined by having release means for releasing said contact figures from said upright position to a position other than said upright position upon contact from an opposing contact figure, whereby each operator participating in play of said amusement device grasps said operator means and manipulates same in combination with said pivot means and said actuator means to attempt contact between said movably arms and said release means of an opposing contact figure, said pivot means comprising a pivot and slide mount secured under said gameboard and adapted to receive said hollow cylinder to allow forward and backward slide motion of said hollow cylinder relative to the center of said gameboard, as well as pivot motion to allow said pedestal end of said hollow cylinder to swing from side to side of said gameboard;

said operator means comprising a handle at said trigger end of said hollow cylinder having a plurality of triggers corresponding to each of said movable arms, said handle being grasped by a player of said amusement device to direct pivot and slide motion of said pivot means, and to trigger said actuator means;

said actuator means is housed within said handle, said hollow cylinder, said pivot pedestal and said contact figure and is comprised of one set of actuation means for each of said movable arms, each set of actuation means having a trigger cooperatively associated with an actuator rod pivotably connected to a pivot plate which is connected to an arm actuator rod, which said arm actuator rod is connected in turn to a shoulder push rod, whereby depression of said trigger end causes pull of said actuator rod which in turn rocks said pivot plate forward causing said arm actuator rod to push upward and in turn push said shoulder push rod upward to thrust said movable arm likewise upward to project contact attempts by upward thrusts of said movable arm, with downward release of said movable arm effected reversely by release of said trigger; said release means comprising a push rod depressably housed within each said contact figure at a position vulnerable of contact by an opposing contact figure, said push rod being cooperatively associated with a pivot lever within said contact figure, said pivot lever cooperatively associated with a release actuator rod within said contact figure and connected to a tension pawl positioned within said pedestal end of said hollow cylinder and below said contact figure, said tension pawl holding said contact figure in said upright position upon said pedestal end, said release means further defined by tensioning means consisting of a first spring and a second spring, said first spring connected directly between said pivot pedestal and said fixed pedestal and set in tensioned position when said contact figure stands upright and allowed to untense when said tension pawl is released from contact with said pivot pedestal, said second spring tensed between said tension pawl and said fixed pedestal and providing additional tensioning force for actuating said release means to effect backward fall of said contact figure; whereby contact by one of said movable arms of an opposing contact figure with said push rod depresses said push rod which pivots said pivot lever which in turn lowers said release actuator rod and thereby pushes said tension pawl away from contact with said contact figure to actuate said tensioning means and cause consequent backward falling of said contact figure.

10. A mechanically operated gameboard amusement device, comprising; in combination:

gameboard having a top playing surface with an accessible underside with a center play area defined by at least one opening in said surface;

a plurality of hollow cylinders, each having a pedestal end and a trigger end, with each of said cylinders movably mounted under said gameboard;

pivot means for movably pivoting and slide mounting each of said cylinders under said gameboard;

operator means for grasping said trigger end of each of said cylinders;

actuator means for delivering mechanical force from said operator means to said pedestal end;

at least two contact figures pivotably mounted upright upon each of said pedestal ends through said opening, each of said contact figures having a contact figure pivot pedestal removably recessed within a fixed pedestal when said contact figure is positioned upright, and each having a plurality of movable arms cooperatively associated with said actuator means to deliver contact force to an opposing contact figure, said contact figures further defined by having release means for releasing said contact figures from said upright position to a position other than said upright position upon contact from an opposing contact figure, whereby each operator participating in play of said amusement device grasps said operator means and manipulates same in combination with said pivot means and said actuator means to attempt contact between said movable arms and said release means of an opposing contact figure, said gameboard having support means depended from each corner of said underside of said gameboard and supported on a base support of the same size and shape as said gameboard;

said pivot means comprising a pivot and slide mount secured to said base support and adapted to receive said hollow cylinder to allow forward and backward slide motion of said hollow cylinder relative the center of said gameboard, as well as pivot motion to allow said pedestal end of said hollow cylinder to swing from side to side of said gameboard;

said operator means comprising a handle at said trigger end of said hollow cylinder having a plurality of triggers corresponding to each of said movable arms said handle being grasped by a player of said amusement device to direct pivot and slide motion of said pivot means, and to trigger said actuator means;

said actuator means is housed within said handle, said hollow cylinder, said pivot pedestal and said contact figure and is comprised of one set of actuation means for each of said movable arms, each set of actuation means having a trigger cooperatively associated with an actuator rod pivotably connected to a pivot plate which is connected to an arm actuator rod, which said arm actuator rod is connected in turn to a shoulder push rod, whereby depression of said trigger causes pull of said arm actuator rod which in turn rocks said pivot plate forward causing said arm actuator rod to push upward and in turn push said shoulder push rod upward to thrust said movable arm likewise upward to project contact attempts by upward thrusts of said movable arm, with downward release of said movable arm effected reversely by release of said trigger;

said release means comprising a push rod depressably housed within each said contact figure at a position vulnerable of contact by an opposing contact figure, said push rod being cooperatively associated with a pivot lever within said contact figure, said pivot lever cooperatively associated with a release actuator rod within said contact figure and connected to a tension pawl positioned within said pedestal end of said hollow cylinder and below said contact figure, said tension pawl holding said contact figure in said upright position upon said pedestal end, said release means further defined by tensioning means consisting essentially of tensioning means consists of a first spring and a second spring, said first spring connected directly between said pivot pedestal and said fixed pedestal and set in tensioned position when said contact figure stands upright and allowed to untense when said tension pawl is release from contact with said pivot pedestal, said second spring tensed between said tension pawl and said fixed pedestal and providing additional tensioning force for actuating said release means to effect backward fall of said contact figure; whereby contact by one of said movable arms of an opposing contact figure with said push rod depresses said push rod which pivots said pivot lever which in turn raises said release actuator rod and thereby pushes said tension pawl away from contact with said contact figure to actuate said tensioning means and cause consequent backward falling of said contact figure;

skill adjustment means for varying the degree of force necessary to activate said release means, said skill adjustment means comprises at least one adjustable plate secured to said pivot pedestal and in a position to adjustably cooperate with said release means to increase the level of force required to effect said release means by increasing contact between said adjustable plate and said release means, and to decrease the level of force required to effect said release means by decreasing contact between said adjustable plate and said release means.

11. The amusement device recited in claim 1, wherein said contact figure is a boxer and said amusement device is the game of boxing with tow opposing said contact figures positioned facing each other and operated by two operators, respectively manipulating each of said contact figures by grasping respective said operator means, said operators means housing two triggers and two respective sets of actuator means, one said trigger and set of actuator means to operate the left arm of said contact figure and the other said trigger to operate the right arm of said contact figure.

12. A hand operated game for two opposing players comprising:

a gameboard having a top playing surface, an accessible underside, and a center play area defined by an opening in said gameboard;

a plurality of independent hollow cylinders, each having a pedestal end and a trigger end, and extending continuously therebetween with each of said cylinders movably mounted under said gameboard;

pivot means for movably pivoting and slide mounting each of said cylinders under said gameboard;

operator means for grasping said trigger end of each of aid cylinders;

actuator means for delivering mechanical force from said operator means to said pedestal end;

a contact figure pivotably mounted upright upon each of said pedestal ends through said opening to stand above said top playing surface, each of said contact figures having a contact figure pivot pedestal recesssed within a fixed pedestal when said contact figure stands upright, and each of said contact figures having a plurality of movable arms cooperatively associated with said actuator means to deliver contact force to an opposing contact figure, and further having release means for releasing said contact figure from said upright position to a fallen back position upon contact from an opposing contact figure, whereby each operator participating in play of said amusement device grasps said operator means and manipulates same in combination with said pivot means and said actuator means to attempt contact between said movable arms and said release means of an opposing contact figure; and skill adjustment means for varying the degree of force necessary to actuate said release means by contact with one of said movable arms of an opposing contact figure.

13. The amusement device recited in claim 12, wherein said pivot means comprises a pivot and slide mount secured to said underside of said gameboard and adapted to receive said hollow cylinder to allow forward and backward slide motion of said hollow cylinder relative to the center of said gameboard, as well as pivot motion to allow said pedestal end of said hollow cylinder to swing from side to side of said gameboard.

14. The amusement device recited in claim 12, further defined by said gameboard having support means depended from each corner of said underside of said gameboard and supported on a base support of generally the same size and shape as said gameboard, wherein said pivot means comprises a pivot and slide mount secured to said base support and adapted to receive said hollow cylinder to allow forward and backward slide motion of said hollow cylinder relative to the center of said gameboard, as well as pivot motion to allow said pedestal end of said hollow cylinder to swing from side to side of said gameboard.

15. The amusement device recited in claim 12, wherein said actuator means is housed within said operator means said hollow cylinder, said pivot pedestal and said contact figure and is comprised of one set of actuation means for each of said movable arms, each set of actuation means having a trigger cooperatively associated with an actuator rod pivotably connected to a pivot plate which is connected to an arm actuator rod, which said arm actuator rod is connected in turn to a shoulder push rod, whereby depression of said trigger end causes pull of said actuator rod which in turn rocks said pivot plate forward causing said arm actuator rod to push upward and in turn push said shoulder push rod upward to thrust said movable arm likewise upward to project contact attempts by upward thrusts of said movable arm, with downward release of said movable arm effected reversely by release of said trigger.

16. The amusement device of claim 12, wherein said release means comprises a push rod depressably housed within each said contact figure at a position vulnerable of contact by an opposing contact figure, said push rod being cooperatively associated with a pivot lever within said contact figure, said pivot lever cooperatively associated with a release actuator rod within said contact figure and connected to a tension pawl pivotably affixed to said fixed pedestal below said contact figure, said tension pawl holding said contact figure in said upright position by forcible contact with said pivot pedestal, said release means further defined by tensioning means to provide tension at said pedestal end while said contact figure is held upright, and to release said tension to provide release force for said contact figure to fall backward upon release of said tension pawl, whereby contact by one of said movable arms of an opposing contact figure with said push rod depresses said push rod which pivots said pivot lever, which in turn lowers said release actuator rod and thereby pushes said tension pawl away from contact with said contact figure to actuate said tensioning means and cause consequent backward fall of said contact figure.

17. A hand operated game for two opposing players comprising:

a gameboard having a top playing surface, an accessible underside, and a center play area defined by an opening in said gameboard;

a plurality of hollow cylinders, each having a pedestal end and a trigger end, with each of said cylinders movably mounted under said gameboard;

pivot means for movably pivoting and slide mounting each of said cylinders under said gameboard;

operator means for grasping said trigger end of each of said cylinders;

actuator means for delivering mechanical force from said operator means to said pedestal end;

a contact figure pivotably mounted upright upon each of aid pedestal ends through said opening to stand above said top playing surface, each of said contact figures having a contact figure pivot pedestal recessed within a fixed pedestal when said contact figure stands upright, and each of said contact figures having a plurality of movable arms cooperatively associated with said actuator means to deliver contact force to an opposing contact figure, and further having release means for releasing said contact figure from said upright position to a fallen back position upon contact from an opposing contact figure, whereby each operator participating in play of said amusement device grasps said operator means and manipulates same in combination with said pivot means and said actuator means to attempt contact between said movable arms and said release means of an opposing contact figure; and skill adjustment means for varying the degree of force necessary to actuate said release means by contact with one of said movable arms of an opposing contact figure, said release means comprises a push rod depressably housed within each said contact figure at a position vulnerable of contact by an opposing contact figure, said push rod being cooperatively associated with a pivot lever within said contact figure, said pivot lever cooperatively associated with a release actuator rod within said contact figure and connected to a tension pawl pivotably affixed to said fixed pedestal below said contact figure, said tension pawl holding said contact figure in said upright position by forcible contact with said pivot pedestal, said release means further defined by tensioning means to provide tension at said pedestal end while said contact figure is held upright, and to release said tension to provide release force for said contact figure to fall backward upon release of aid tension pawl, whereby contact by one of said movable arms of an opposing contact figure with said push rod depresses said push rod which pivots said pivot lever, which in turn lowers said release actuator rod and thereby pushes said tension pawl away from contact with said contact figure to actuate said tensioning means and cause consequent backward falling of said contact figure, wherein said tensioning means consist of a first spring and a second spring, said first spring connected directly between said pivot pedestal and said fixed pedestal and set in tensioned position when said contact figure stands upright and allowed to untense said first spring when said tension pawl is released from contact with said pivot pedestal, said second spring tensed between said tension pawl and said fixed pedestal and providing additional tensioning force for actuating said release means to effect backward falling fall of said contact figure.

18. The amusement device of claim 12, wherein said skill adjustment means comprises at least one adjustable plate secured to said pivot pedestal and in a position to adjustably cooperate with said release means to increase the level of force required to effect said release means by increasing contact and tension between said adjustable plate and said release means, and to decrease the level of force required to effect said release means by decreasing contact and tension between said adjustable plate and said release means.

19. A hand operated game for two opposing players comprising:

a gameboard having a top playing surface, an accessible underside, and a center play area defined by an opening in said gameboard;

a plurality of hollow cylinders, each having a pedestal end and a trigger end, with each of said cylinders movably mounted under said gameboard;

pivot means for movably pivoting and slide mounting each of said cylinders under said gameboard;

operator means for grasping said trigger end of each of said cylinders;

actuator means for delivering mechanical force from said operator means to said pedestal end;

a contact figure pivotably mounted upright upon each of said pedestal ends through said opening to stand above said top playing surface, each of said contact figures having a contact figure pivot pedestal recessed within a fixed pedestal when said contact figure stands upright, and each of said contact figures having a plurality of movable arms cooperatively associated with said actuator means to deliver contact force to an opposing contact figure, and further having release means for releasing said contact figure from said upright position to a fallen back position upon contact from an opposing contact figure, whereby each operator participating in play of said amusement device grasps said operator means and manipulates same in combination with said pivot means and said actuator means to attempt contact between said movable arms and said release means of an opposing contact figure; and skill adjustment means for varying the degree of force necessary to actuate said release means by contact with one of said movable arms of an opposing contact figure;

said pivot means comprising a pivot and slide mount secured under said gameboard and adapted to receive said hollow cylinder to allow forward and backward slide motion of said hollow cylinder relative tot he center of said gameboard, as well as pivot motion to allow said pedestal end of said hollow cylinder to swing from side to side of said gameboard;

said operator means comprising a handle at said trigger end of said hollow cylinder having a plurality of triggers corresponding to each of said movable arms, said handle being grasped by a player of said amusement device to direct pivot and slide motion of said pivot means, and to trigger said actuator means;

said actuator means housed within said handle, said hollow cylinder, said pivot pedestal and said contact figure and is comprised of one set of actuation means for each of said movable arms, each set of actuation means having a trigger cooperatively associated with an actuator rod pivotably connected to a pivot plate which is connected to an arm actuator rod, which said arm actuator rod is connected in turn to a shoulder push rod, whereby depression of said trigger end causes pull of said actuator rod which in turn rocks said pivot plate forward causing aid arm actuator rod to push upward and in turn push said shoulder push rod upward to thrust said movable arm likewise upward to project contact attempts by upward thrusts of said movable arm, with downward release of said movable arm effected reversely by release of said trigger;

said release means comprising a push rod depressably housed within each said contact figure at a position vulnerable of contact by an opposing contact figure, said push rod being cooperatively associated with a pivot lever within said contact figure, said pivot lever cooperatively associated with a release actuator rod within said contact figure and connected to a tension pawl positioned within said pedestal end of said hollow cylinder and below aid contact figure, said tension pawl holding said contact figure in said upright position upon said pedestal end, said release means further defined by tensioning means consisting essentially of a first spring and a second spring, said first spring connected directly between said pivot pedestal and said fixed pedestal and set in tensioned position when said contact figure stands upright and allowed to untense when said tension pawl is release from contact with said pivot pedestal, said second spring tensed between said tension pawl and said fixed pedestal and providing additional tensioning force for actuating said release means to effect backward fall of said contact figure; whereby contact by one of said movable arms of an opposing said contact figure with said push rod depresses said push rod which pivots said pivot lever which in turn lowers said release actuator rod and thereby pushes said tension pawl away from contact with said contact figure to actuate said tensioning means and cause consequent backward falling of said contact figure; and said skill adjustment means comprises at least one adjustable plate secured to said pivot pedestal and in a position to adjustably cooperate with said release means to increase the level of force required to effect aid release means by increasing contact and tension between said adjustable plate and said release means, and to decrease the level of force required to effect said release means by decreasing contact and tension between aid adjustable plate and said release means.

20. A hand operated game for two opposing players comprising:

a gameboard having a top playing surface, an accessible underside, and a center play area defined by an opening in aid gameboard;

a plurality of hollow cylinders, each having a pedestal end and a trigger end, with each of said cylinders movably mounted under said gameboard;

pivot means for movably pivoting and slide mounting each of said cylinders under said gameboard;

operator means for grasping said trigger end of each of said cylinders;

actuator means for delivering mechanical force from said operator means to said pedestal end;

a contact figure pivotably mounted upright upon each of said pedestal ends through said contact figures having a contact figure pivot pedestal recessed within a fixed pedestal when said contact figure stands upright, and each of said contact figures having a plurality of movable arms cooperatively associated with said actuator means to deliver contact force to an opposing contact figure, and further having release means for releasing said contact figure from said upright position to a fallen back position upon contact from an opposing contact figure, whereby each operator participating in play of said amusement device grasps said operator mean sand manipulates same in combination with said pivot means and said actuator means to attempt contact between said movable arms and said release means of an opposing contact figure; and skill adjustment means for varying the degree of force necessary to actuate said release means by contact with one of said movable arms of an opposing contact figure;

said pivot means comprising a pivot and slide mount secured under said gameboard and adapted to receive said hollow cylinder to allow forward and backward slide motion of said hollow cylinder relative the center of said gameboard, as well as pivot motion to allow said pedestal end of said hollow cylinder to swing from side to side of said gameboard;

said operator means comprising a handle at said trigger end of said hollow cylinder having a plurality of triggers corresponding to each of said movable arms, said handle being grasped by a player of said amusement device to direct pivot and slide motion of said pivot means, and to trigger said actuator means;

said actuator means is housed within said handle, said hollow cylinder, said pivot pedestal and said contact figure and is comprised of one set of actuation means for each of said movable arms, each set of actuation means having a trigger cooperatively associated with an actuator rod pivotably connected to a pivot plate which is connected to an arm actuator rod, which said arm actuator rod is connected in turn to a shoulder push rod, whereby depression of said trigger end causes pull of said actuator rod which in turn rocks said pivot plate forward causing said arm actuator rod to push upward and in turn push said shoulder push rod upward to thrust said movable arm likewise upward to project contact attempts by upward thrusts of said movable arm, with downward release of said movable arm effected reversely by release of said trigger;

said release means comprising a push rod depressably housed within each said contact figure at a position vulnerable of contact by an opposing contact figure, said push rod being cooperatively associated with a pivot lever within said contact figure, said pivot lever cooperatively associated with a release actuator rod within said contact figure and connected to a tension pawl positioned within said pedestal end of said hollow cylinder and below said contact figure, said tension pawl holding said contact figure in said upright position upon said pedestal end, said release means further defined by tensioning means consisting essentially of a first spring and a second spring, said first spring connected directly between said pivot pedestal and said fixed pedestal and set in tensioned position when said contact figure stands upright and allowed to untense when said tension pawl is released from contact with said pivot pedestal, said second spring tensed between said tensioning pawl and said fixed pedestal and providing additional tensioning force for actuating said release means to effect backward falling of said contact figure; whereby contact by one of said movable arms of an opposing contact figure with said push rod depresses said push rod which pivots said pivot lever which in turn raises said release actuator rod and thereby pushes said tension pawl away from contact with said contact figure to actuate said tensioning means and cause consequent backward falling of said contact figure; and said skill adjustment means comprises at least one adjustable plate secured to said pivot pedestal end and in a position to adjustably cooperate with said release means to increase the level of force required to effect said release means by increasing contact and tension between said adjustable plate and said release means, and to decrease the level of force required to effect said release means by decreasing contact and tension between said adjustable plate and said release means.

* * * * *